US008148266B2

(12) United States Patent
Eisenstock et al.

(10) Patent No.: US 8,148,266 B2
(45) Date of Patent: Apr. 3, 2012

(54) METHOD AND APPARATUS FOR CONFORMABLE POLISHING

(75) Inventors: Gregory Eisenstock, Rochester, NY (US); Anurag Jain, Painted Post, NY (US)

(73) Assignee: Corning Incorporated, Corning, NY (US)

( * ) Notice: Subject to any disclaimer, the term of this patent is extended or adjusted under 35 U.S.C. 154(b) by 184 days.

(21) Appl. No.: 12/759,214

(22) Filed: Apr. 13, 2010

(65) Prior Publication Data

US 2011/0127643 A1 Jun. 2, 2011

Related U.S. Application Data

(60) Provisional application No. 61/265,154, filed on Nov. 30, 2009.

(51) Int. Cl.
*B24B 29/00* (2006.01)

(52) U.S. Cl. .. 438/692; 451/288; 451/398; 257/E21.237

(58) Field of Classification Search ..... 438/692; 257/E21.237; 451/288, 398
See application file for complete search history.

(56) References Cited

U.S. PATENT DOCUMENTS

| | | | | |
|---|---|---|---|---|
| 5,374,654 | A | 12/1994 | Vorbruggen et al. | 514/530 |
| 5,931,725 | A * | 8/1999 | Inaba et al. | 451/288 |
| 6,013,563 | A | 1/2000 | Henley et al. | 438/458 |
| 7,176,528 | B2 | 2/2007 | Couillard et al. | 257/347 |
| 7,207,871 | B1 | 4/2007 | Zuniga et al. | 451/288 |
| 7,223,158 | B2 | 5/2007 | Boo et al. | 451/41 |
| 7,357,703 | B2 | 4/2008 | Nishimura et al. | 451/527 |
| 7,364,496 | B2 | 4/2008 | Berkstresser et al. | 451/41 |
| 7,445,543 | B2 | 11/2008 | Torii et al. | 451/289 |
| 2004/0209559 | A1 | 10/2004 | Birang et al. | 451/285 |
| 2007/0197145 | A1 | 8/2007 | Menk et al. | 451/164 |
| 2008/0299871 | A1 | 12/2008 | Eisenstock et al. | 451/23 |

* cited by examiner

*Primary Examiner* — Minh-Loan T Tran
(74) *Attorney, Agent, or Firm* — Bruce P. Watson

(57) ABSTRACT

A multi-station polish system and process for polishing thin, flat (planar) and rigid workpieces. Workpieces are conveyed through multiple polishing stations that include a bulk material removal belt polishing station and finishing rotary polishing station. The bulk of the material is relatively quickly removed at the bulk removal station using a conformable abrasive belt and the workpiece surface is then polished to the desired finish at the finishing station using a conformable annular rotary polishing pad.

25 Claims, 8 Drawing Sheets

METHOD AND APPARATUS FOR CONFORMABLE POLISHING

PRIORITY

This application claims priority to U.S. Provisional Patent Application No. 61/265,154, filed Nov. 30, 2009, titled "Methods and Apparatus for Conformable Polishing".

BACKGROUND OF THE INVENTION

The present invention relates to methods and apparatus for polishing substrates using chemical mechanical polishing ("CMP"), more specifically, conformable CMP polishing of semiconductor wafers or tiles, semiconductor on insulator substrates, or semiconductor on glass substrates.

CMP processes and equipment have been employed in polishing substrates such as semiconductor wafers for use as substrates for solid state electronic devices. High electrical performance semiconductor on insulator (SOI) technology, an engineered multilayer semiconductor substrate, has been employed for high performance thin film transistors, CPU's, and may be used for solar cells, and flat panel displays, such as active matrix liquid crystal (AMLCD) and organic light emitting diode (AMOLED) displays. SOI structures or substrates include a thin layer of substantially single crystal semiconductor material on an insulating semiconductor material. For example, an SOI substrate may include a thin single crystal silicon layer on an insulating amorphous or polycrystalline silicon material. A less expensive glass or glass-ceramic material may be used to form the insulating or handle substrate in place of the much more expensive semiconductor material, thereby producing a single crystal silicon (or other single crystal semiconductor material) on glass "SOG" substrates suitable for displays, sensors, photovoltaics, solar cells and other applications.

SOG substrates may be considered a subset of SOI substrates. Unless otherwise expressly stated or described herein, all descriptions of SOI products and processes contained herein are intended to include SOG products and processes as well as other types of SOI products and processes.

One way of obtaining the thin semiconductor layers required for SOI structures is epitaxial growth of silicon (Si) on lattice matched substrates. An alternative process includes the bonding of a single crystal silicon wafer to another silicon wafer on which an oxide layer of $SiO_2$ has been grown, followed by polishing or etching of the top wafer down to, for example, a 0.05 to 0.3 micron layer of single crystal silicon. Further methods include ion-implantation of ions, such as hydrogen, helium or oxygen ions, to either (a) form a buried oxide layer in the silicon wafer topped by Si in the case of oxygen ion implantation, or (b) form a weakened layer in the silicon donor wafer in order to separate (exfoliate) a thin Si layer for film from the donor wafer in the case of hydrogen or helium ion implantation. Such processes have been used to separate a thin layer or film of silicon or other semiconductor material from a donor wafer and transfer the thin film to a handle or insulating substrate to produce an SOI substrate. Such processes are referred to herein as "ion implantation thin film transfer processes" or simply "thin film transfer processes."

Several methods have been employed to separate the thin layer or film from the donor wafer in ion implantation thin film transfer processes and bond the silicon layer to an insulating substrate. U.S. Pat. Nos. 5,374,564 and 6,013,563 disclose a thermal bonding and separation thin film transfer process for producing SOI substrates, in which an ion implanted single crystal silicon donor wafer is brought into contact with a surface of an insulating semiconductor substrate or handle wafer. Heat, e.g. thermal energy, is then applied to thermally bond the donor wafer to the handle wafer and separate a thin layer of silicon from the donor wafer, thereby leaving a thin film of single crystal silicon (or other single crystal semiconductor material) thermally bonded to the handle wafer. U.S. Pat. No. 7,176,528 discloses an anodic bonding and separation ion implantation thin film transfer process for producing SOG substrates, in which an ion implanted single crystal silicon donor wafer is brought into contact with a surface of an insulating glass or glass ceramic substrate. Heat and voltage are applied to the wafer and the glass substrate (pressure may also be applied) to anodically bond the wafer to the glass substrate and separate a thin layer of silicon from the wafer, thereby leaving a thin film of single crystal silicon (or other single crystal semiconductor material) anodically bonded to the glass substrate.

After the removal of a first thin layer or film of silicon (or other semiconductor material) from the donor semiconductor wafer in an SOG process, which may remove only a 200 nanometer to 800 nanometer layer of material, about 99% or more of the donor semiconductor wafer remains. Due to the relatively high cost of single crystal silicon and other semiconductor materials, it is desirable to re-use the remaining portion of the donor wafer as many times as possible to reduce material costs. Large area SOI structures may be produced by arraying a plurality of laterally disposed individual rectangular donor wafers (or "tiles") on a single insulating substrate (such as a display grade sheet of glass or glass-ceramic material), separating a plurality of thin rectangular semiconductor layers from the tiles, and bonding the layers to the insulating substrate (a process referred to herein as "tiling"). Use of a plurality of donor wafers or tiles multiplies the economic savings achievable through re-use of the donor wafers.

After separation of a layer from a donor semiconductor wafer in an ion implantation thin film transfer process, the exfoliated or cleaved surface of the donor wafer and of the SOI substrate includes residual ions from the implantation process and crystalline damage from the implantation and separation process. In order to re-use a donor semiconductor wafer, it is necessary to refinish or refresh the wafer by curing or removing the exfoliated surface to return it to a relatively damage-free and ion contamination free state. Similarly, in order to provide the resulting SOI substrate with the desired electrical properties, it is necessary to refresh or remove the ion contaminated and damaged outer layer of the exfoliated surface of the SOI substrate. This ion contaminated and damaged outer layer of the donor wafer and of the SOI substrate has been removed using conventional CMP techniques. While CMP techniques are well documented and existing equipment may be readily obtained, there are a number of drawbacks with the existing CMP technology in the context of semiconductor re-use in ion implantation thin film transfer processes.

FIG. 1 is a diagrammatic illustration of a conventional chemical, mechanical polishing ("CMP") setup, in which a workpiece 1 is mounted on a carrier or polishing head 3 using a vacuum/suction or surface tension. An exposed surface of the wafer is pressed against a polishing pad 5, which may be a standard pad or a fixed-abrasive pad, mounted on a rigid turn table 7 to create relative motion between the abrasive pad and the wafer. A standard pad has a durable roughened surface, whereas a fixed-abrasive pad has abrasive particles held in a containment media. A polishing slurry, including a chemically-reactive agent (and abrasive particles if a standard pad is used) is applied to the surface of the polishing pad. The carrier head provides a controllable load, i.e., pressure, on the substrate 1 to push it against the polishing pad 5. In order to achieve a more uniform polishing across the surface of the wafer, mechanisms may be provided in the polisher head to apply uniform pressure on the back surface of the wafer and a reciprocating, oscillating or orbital motion may be provided between the polisher head 3 and the turn table. CMP processes provide a high polishing rate and a resulting flat planar substrate surface that is free of significant large scale surface topography (e.g. substantially planar/flat) and small-scale surface roughness (e.g. substantially smooth).

As shown in FIG. 1, conventional CMP processes apply the polishing pressure to the back surface of a relatively rigid workpiece having a finite modulus of elasticity (e.g. the semiconductor donor wafer in the case of SOI fabrication processes). This method of pressure application results in a non-uniform pressure distribution across the wafer surface. Line A in FIG. 2 plots the results of a finite element analysis of the pressure distribution across a round wafer during polishing in a conventional CMP system. As can be seen in FIG. 2, the polishing pressure is highest in the middle and decreases to zero at the wafer edges. This uneven pressure distribution results in non-uniform material removal across the wafer surface which affects the flatness of the polished wafer. The flatness or planarity requirements of the semiconductor donor wafers used for SOI applications are stringent and are typically in the range of less than 5 μm (5000 nm) variations in amplitude and over 20 mm in pitch, e.g. distance from peak to peak.

As a result of the non-uniform material removal with conventional CMP processes, an excess amount of material must be removed from the exfoliated surface of the donor wafer to adequately refresh the surface of the donor wafer for reuse with convention CMP processes. For example, if 0.150 microns (150 nm) of actual damage and contamination needs to be removed from the exfoliated surface of a donor wafer, then to be certain that the damage and contaminated layer has been completely removed from the whole surface of the donor wafer, taking into account the aforementioned non-uniform characteristics of the CMP protocols, at least 1.0 micron (1000 nm) may need to be removed from the donor wafer. Thus, over six times the thickness of the actual damage may need to be removed in order to ensure that all the damage and contamination is removed, which is highly wasteful and has significant negative cost implications.

Conventional CMP processes may exhibit particularly poor results when polishing non-round semiconductor wafers or SOI substrates having sharp corners, such as rectangular donor wafers or tiles, as may be employed when tiling to produce large area SOI and SOG substrates. The aforementioned non-uniform material removal is amplified at the corners of rectangular donor wafers due to higher polishing speed and non-uniform polishing pressure at these locations, which result in faster material removal at the corners of the wafer compared with the center of the wafer. This is know as the "pillow" or "pillowing effect," because the rectangular donor wafer takes on a non-planar pillow-like shape with reduced thickness at the corners compared to the central region of the rectangular donor wafers or tiles. Multiple re-uses of rectangular donor wafers by such CMP protocols multiplies the pillow effect, resulting in the premature end to a given wafer's re-use life cycle as the surface geometry (especially near the corners) diverges from acceptable re-use functional limits as result of the pillowing effect. Thus, the number of times a rectangular wafer can be effectively re-used employing conventional CMP techniques is limited. Therefore, there is a need for a process of refinishing or refreshing the surface of semiconductor donor wafers, especially rectangular semiconductor donor tiles, that increases the number of times that a donor wafer or donor tile may be reused in an ion implantation thin film transfer SOI fabrication process.

Conventional planarizing CMP processes and equipment are also often unsatisfactory for polishing of substrates with very thin layers thereon, such as SOI substrates. FIG. 3 (not drawn to scale) diagrammatically illustrates an SOG substrate 11 that maybe used, for example, as a backplane substrate for liquid crystal display (LCD) or organic light emitting diode (OLED) display panels, sensors, photovoltaics, solar cells, etc.

An SOG substrate includes an insulating substrate of glass or glass ceramic 13. Glass or glass-ceramic substrates typically have relatively large variations in surface topography as compared to a semiconductor wafer in an SOI process and as compared to the thin semiconductor layer on an SOG substrate. For example, as illustrated in FIG. 3, a glass substrate may have large scale or macro surface variations or undulations with high spots 17 and low spots 19 that may have an amplitude of about 20 μm (20000 nm). Whereas the semiconductor layer 15 on the glass substrate 13 is a very thin layer or layers of material that conforms to the macro surface topography of the glass substrate surface. These thin semiconductor layers or films typically have a thickness on the order of several hundreds of nanometers thick, which is thinner by many orders of magnitude than the amplitude of the macro surface topography variations of the underlying glass substrate of 20000 nanometers. For example, a semiconductor layer 15 having an initial thickness of about 420 nm may be transferred from a donor wafer onto the glass substrate in an ion implantation thin film transfer process. This "as transferred" layer must then be thinned to remove the ion contaminated and damaged outer layer and thin the layer down to the desired final thickness of about 200 nm by removing about 220 nm of material. Thus, the 20 μm (20000 nm) variations in surface topography of the underlying substrate is about a hundred times larger than the 200 nm thickness of the final Si layer 7 and the 220 nm layer of material that must be removed in order to obtain the desired final 200 nm layer thickness.

When conventional planarizing CMP polishing techniques are employed to thin an as deposited silicon layer 17 on an SOI substrate 11, the entire as deposited silicon layer is often unacceptably removed from the high spots 17 of the large scale undulations on the insulating glass substrate 13. For example, if an SOG substrate 11 were thinned down to the plane designated by line P in FIG. 3, then the entire silicon layer 15 would be removed from the high spots 17 of the undulations in the surface of the glass, thus creating holes through the silicon layer 15. Yet, the damaged and contaminated top layer of the as transferred silicon layer 15 may remain untouched and un-thinned over the low spots 19. In order to avoid removing entire portions of the layer(s) and creating holes in the layer(s), the finishing apparatus should compensate for or conform to the undulating surface of the thin film 15 while removing material therefrom, such that material is substantially uniformly removed across the surface of the film. Commonly owned pending Published U.S. Application 2008/0299871A1 discloses a conformable polishing apparatus.

Conventional CMP techniques are also relatively expensive. A conventional CMP set-up includes a rotating polishing pad (having certain abrasive characteristics), a slurry (also having certain abrasive characteristics), and a rotating chuck or head to press the semiconductor wafer against the polishing pad and slurry. In order to obtain a semiconductor wafer with satisfactory surface characteristics in a re-use or as transferred layer thinning context, multiple equipment set-ups are required. For example, multiple polishing pads of varying aggressiveness may be required. This requires either a manual process steps to change the polishing pad on a given piece of equipment, or multiple pieces of equipment each with a different polishing pad. Either approach adds equipment cost and cycle time to the manufacturing process and adversely impacts the commercial viability of the SOI substrates in end-use applications. Furthermore, the workpieces must be loaded one at a time into the polishing head.

In an ion implantation thin film transfer process, the final cost of the SOI product and of products made with SOI substrates is driven by the ability to (a) efficiently and economically thin and finish the SOI substrates and (b) re-use (e.g. refresh or refinish) the donor semiconductor wafers many times. Accordingly, there is a need for an efficient and effective "conformable" polishing process for thinning the as transferred thin film on an SOI or SOG substrate in an ion implantation thin film transfer process and other thin film fabrication processes. There is also a need for refreshing the donor semiconductor wafer, especially rectangular semiconductor donor tiles, as many times as possible. There is also a need for an efficient and affordable continuous process for thinning and finishing a plurality of donor wafers and/or SOI substrates for the economical commercial mass production of SOI substrates.

SUMMARY

In accordance with one aspect of the present invention, polishing of a workpiece, such Silicon wafers or tiles and SOI substrates, is performed as a continuous process on a conveyor. The proposed process utilizes the linear movement of the part in a direction parallel to the surface of the polishing pad to generate substantially uniform velocity across the surface of the workpiece, and utilizes a conformable polishing pad to generate substantially uniform pressure across the surface of the workpiece.

According to one aspect of a polishing system as described herein, a workpiece to be polished or finished is mounted on a conveyor and may be conveyed through multiple polishing stations. The polishing stations may include at least a first bulk material removal polishing station and a second finishing polishing station. The bulk of the material to be removed is relatively quickly removed from the workpiece surface at the bulk removal station and the workpiece surfaces polished to the desired finish at the finishing polishing station, or station B.

The bulk removal station may include a polishing belt that moves in a direction perpendicular to the direction of travel of the wafer and is conformably pressed against the wafer for relatively fast, bulk material removal. The belt may be an abrasive belt or abrasives may be supplied to the belt and workpiece interface in a CMP polishing slurry. Finishing or polishing of the wafer is performed at the polishing station, or station B, which includes a polishing pad on a rotating polishing head with a pressurized fluid chamber for pressing the polishing pad against the wafer. The polishing slurry, such as Cerium oxide, supplied to the interface between the polishing pad and the wafer, the speed of the conveyor and polisher, polishing pressure, and the design of a polishing pad can be selected to achieve relatively high removal rates, while generating good surface uniformity and finish.

According to another aspect of the present invention a conformable polishing apparatus includes: a bulk material removal station; a finishing polishing station; a conveyor on which a plurality of substrates may be releasably coupled and conveyed, one workpiece at a time, through the bulk material removal station and the finishing station in a continuous process; the bulk material removal station includes a moving conformable abrasive belt located with respect to the conveyor such that the abrasive belt conformably contacts a top surface of a substrate travelling through the bulk removal station with a substantially uniform polishing pressure and polishing time across a full width of the substrate and uniformly removes material from the entire top surface of the substrate; and the finishing polishing station includes a rotary conformable annular polishing pad located with respect to the conveyor such that the polishing pad conformably contacts a top surface of a substrate travelling through the finishing station with a substantially uniform polishing pressure and polishing time across a full width of the substrate and uniformly removes material from the entire top surface of the substrate.

The bulk material removal station may further include a hydrostatic pressure head for pressing the belt against a surface of a workpiece. The hydrostatic pressure head may include a cup-shaped housing, the housing having a rim facing and spaced from the belt defining a gap between the rim of the housing and the belt, a polishing slurry supply port in the housing for supplying polishing slurry to an interior of said head and through the gap to a surface of the workpiece, the gap and slurry flow rate being selected to provide a desired polishing pressure in the interior of the pressure head for pressing the belt against a surface of a workpiece.

The hydrostatic pressure head may include: a polishing slurry supply port in the housing; a pressure head vertically movably mounted in the housing, the rim being formed by the pressure head, the pressure head dividing an interior of the housing into a first pressure zone between the head and the belt and a second pressure zone between the head and the housing in communication with the supply port; an orifice in the pressure head communicates the first pressure zone with the second pressure zone to equalize the pressure in the first pressure zone with the pressure in the second pressure zone when polishing slurry is supplied under pressure through the supply port to the second pressure zone, through the orifice to the first pressure zone and through the gap, and thereby providing a substantially constant and uniform pressure in the first pressure zone against a back side of the belt to press the belt against a surface of a workpiece with a substantially uniform and constant polishing pressure.

The finishing polishing station may include a rotary polisher having a resiliently conformable annular polishing pad mounted thereon for contacting and resiliently conforming to a surface of a workpiece. The rotary polisher may further include: a rotary polishing head, a cavity in the rotary polishing head behind the annular polishing pad, and a pressurized fluid supply channel communicating with the cavity for providing fluid at a controlled pressure to the cavity and conformably pressing the annular polishing pad against a surface of a workpiece coupled to the base with a uniform pressure. A supply conduit may extend axially through a center of the polishing head and a center of the polishing pad for supplying polishing slurry to a center of the polishing pad.

The cavity may be an open cavity and an elastic membrane may span and sealingly enclose the cavity to form a pressure cavity in the rotary polishing head. The annular polishing pad may be mounted on an outer surface of the elastic membrane. A fluid supply channel in the polishing head may communicate with the pressure cavity for providing fluid at a controlled pressure to the pressure cavity for inflating the elastic membrane and conformably pressing the annular polishing pad against a surface of a workpiece coupled to the base with a uniform pressure.

The rotary polisher may include a spindle; with the rotary polishing head being mounted on an end of the spindle; a supply conduit extending axially through a center of the spindle; and a hole in a center of the elastic membrane defining an inner peripheral edge on the elastic membrane, wherein the inner peripheral edge of the elastic membrane is sealingly attached to an end of the supply conduit, such that polishing slurry is supplied through the supply conduit to a center of the annular polishing pad.

The finishing polishing station may include a rotary polishing head; an inflatable elastic membrane on an outer face of the rotary polishing head, with the flexible annular polishing pad attached to an outer surface of the inflatable elastic membrane; and a means for inflating the elastic membrane to a controlled pressure and conformably pressing the polishing pad against a surface of a workpiece with a uniform polishing pressure. The bulk material removal station may further include a hydrostatic pressure head for pressing the belt against a surface of a workpiece.

The hydrostatic pressure head may further include a cup-shaped housing, the housing having a rim facing and spaced from the belt defining a gap between the rim of the housing and the belt, a polishing slurry supply port in the housing for supplying polishing slurry to an interior of said head and through the gap to a surface of the workpiece, the gap and slurry flow rate being selected to provide a desired polishing pressure in the interior of the pressure head for pressing the belt against a surface of a workpiece.

The bulk material removal station may include a self compensating hydrostatic pressure head in fluid communication with one of the moving belt such that the pad is operable to control the pressure between the moving belt and the top surface of the substrate in the associated pressure zone.

The present invention also provides a method of conformable polishing and uniformly removing material from a surface of a workpiece, comprising: mounting a flat workpiece on a conveyor and conveying the workpiece through a bulk material removal station and a finishing station; removing material from a top surface of the workpiece using a continuous conformable abrasive belt in the bulk material removal station, such that the conformable belt conforms to the surface of the workpiece to apply a substantially uniform polishing pressure and removes a substantially uniform thickness of material from the surface of the workpiece as the workpiece travels through the bulk material removal station; and polishing the top surface of the workpiece to a desired surface finish at the finishing station with a rotating conformable annular polishing pad, such that the conformable annular polishing pad conforms to the surface of the workpiece to apply a substantially uniform polishing pressure and removes a substantially uniform thickness of material from the surface of the workpiece as the workpiece travels through the finishing station.

The step of polishing at the finishing station may include providing an inflatable elastic membrane behind the annular polishing pad, inflating the elastic membrane, and thereby conformably pressing the annular polishing pad against the surface of the workpiece with a substantially uniform pressure. The polishing slurry may be supplied through a center of the elastic membrane and a center of the polishing pad to the surface of the workpiece.

According to one aspect of the present invention, the workpiece being polished has an undulating surface and a layer of material on the undulating surface, the layer of material having a thickness that is less than a height of undulations on the surface; and the steps of removing material at the bulk material removal station and polishing at the finishing station each remove a substantially uniform thickness of material from the layer of material without entirely removing the layer of material at a top of any undulations on the surface of the workpiece. The layer of material may be thinner than the height of the undulations by a factor of 10 or more. The workpiece may be a flat rectangular workpiece. The workpiece may also be a non-round workpiece, such as a flat rectangular workpiece.

The step of removing material at the bulk material removal station further comprises generating a uniform hydrostatic pressure against a surface of a workpiece. The uniform hydrostatic pressure may be self balancing.

The step of polishing at the finishing station may include providing an inflatable elastic membrane behind the annular polishing pad, inflating the elastic membrane, and thereby conformably pressing the annular polishing pad against the surface of the workpiece with a substantially uniform pressure. Polishing slurry may be supplied through a center of the elastic membrane and a center of the polishing pad to the surface of the workpiece.

Other aspects, features, and advantages of the present invention will be apparent to one skilled in the art from the description herein taken in conjunction with the accompanying drawings.

DESCRIPTION OF THE DRAWINGS

Other aspects, features, and advantages of the present invention will be apparent to one skilled in the art from the description herein in conjunction with the accompanying drawings, wherein like numerals indicate like elements. It being understood, however, that the invention is not intended to be limited to the precise arrangements and instrumentalities shown in the accompanying drawings, of which.

DETAILED DESCRIPTION

Figure 4:
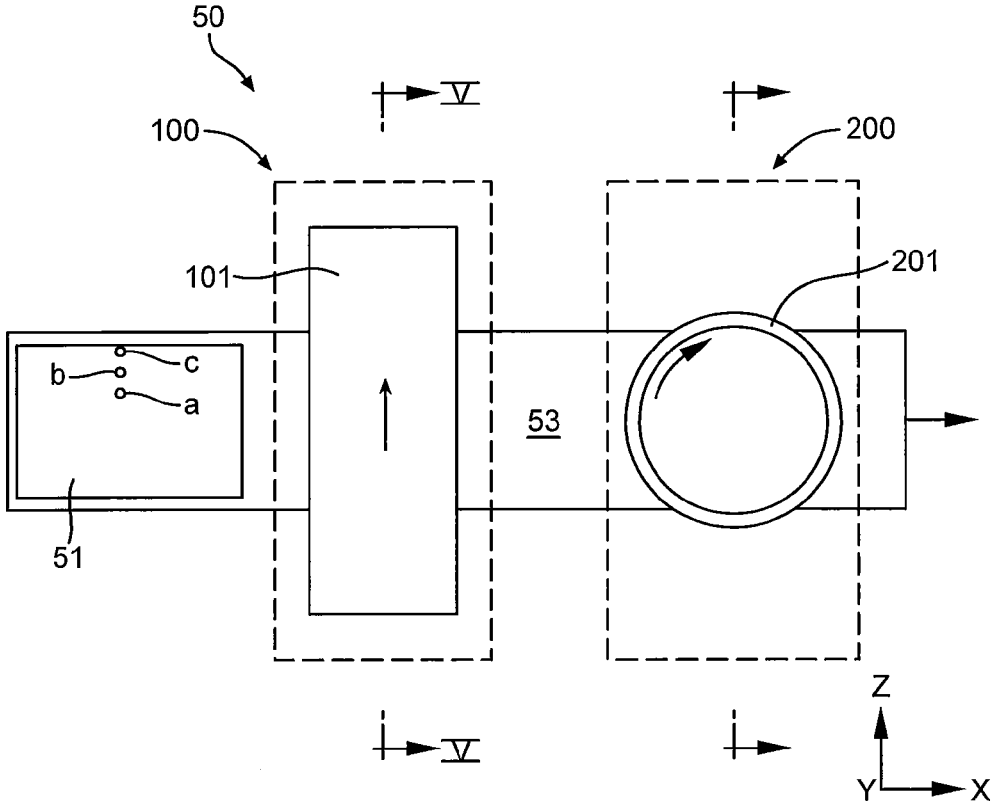
FIG. 4 is a schematic top plan view of a polishing system in accordance with one embodiment of the present invention.

A multi-station polish system 50 in accordance with one or more embodiments of the present invention is diagrammatically illustrated in FIG. 4. A relatively thin, flat (planar) and rigid workpiece 51, such as a silicon wafer, SOI substrate or other engineered substrate, is mounted in a known manner on a conveyor 53 and is conveyed through multiple polishing stations. The conveyor may include a plurality of vacuum chucks for holding the workpiece in place throughout the process. Alternatively, the conveyor may be a porous belt, through which a vacuum is drawn from below, at least in the vicinity of the polishing stations, in order to hold the workpieces in place during each polishing operation.

The polishing stations may include at least a bulk material removal polishing station 100 and a finishing polishing station 200. The bulk of the material to be removed from the workpiece surface is relatively quickly removed at the bulk removal station 100 using a conformable abrasive belt 101. The workpiece surface 51 is then polished to the desired fine finish at the finishing station 200 using a conformable annular polishing pad 201 on a rotary polishing head. After rotary finishing polishing, the workpiece may travel on the conveyor 101 through conventional cleaning, metrology and packaging stations (not shown).

Figure 2:
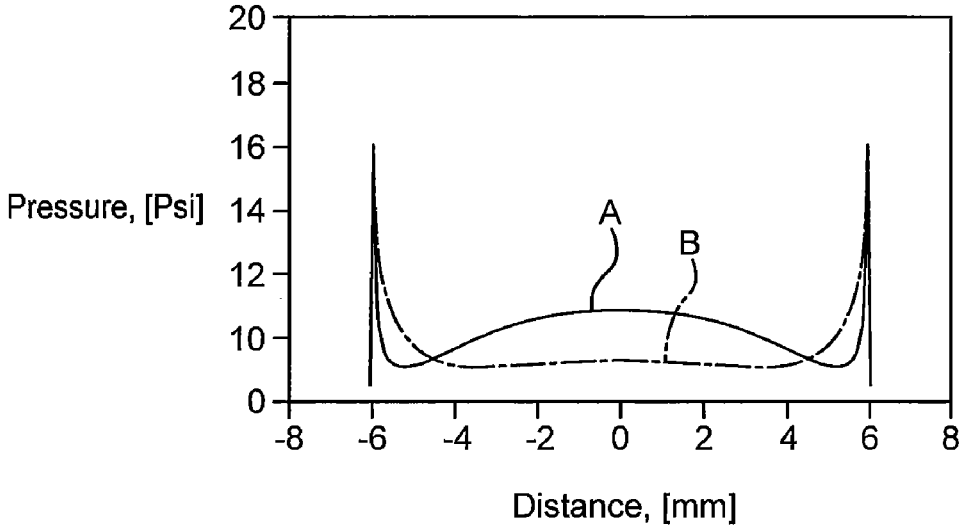
FIG. 2 is a graph illustrating the polishing pressure applied across a surface of a workpiece in a conventional CMP system and in a CMP system according to one embodiment of the present invention as calculated using finite element analysis.

In conventional CMP processes, in which the polishing pressure is applied to the back of the relatively rigid workpiece, such as a semiconductor wafer or SOI substrate. The stiffness of the workpiece results in a non-uniform pressure distribution across the workpiece surface, with the highest pressure at the center of the wafer which gradually decreases to zero at the wafer edge, as illustrated by line A in FIG. 2.

Figure 1:
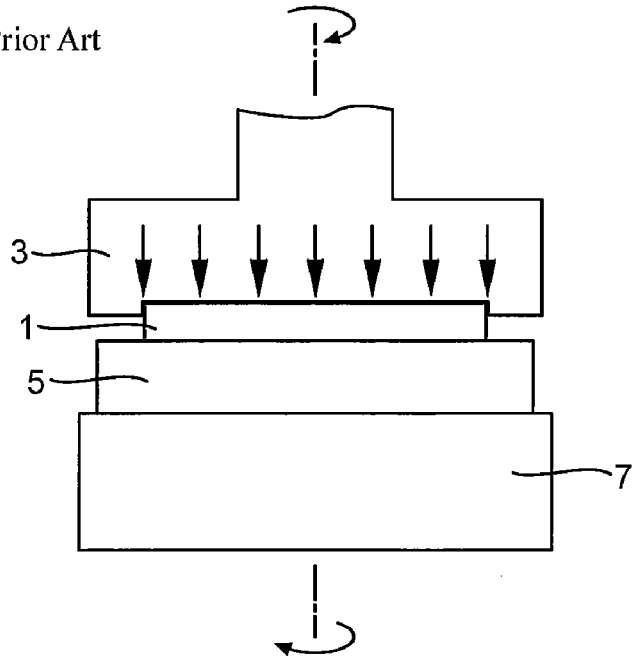
FIG. 1 Prior Art
FIG. 1 is a schematic side elevational view of a conventional prior art CMP polishing system.

In the polishing process described herein, pressure is applied to the workpiece surface by means of a conformable polishing belt 101 and a conformable polishing pad 201. The conformable polishing belt and the conformable annular polishing pad are more elastic or conformable than the typically much stiffer and more rigid semiconductor or SOI workpiece. The relatively elastic polishing belt and polishing pad conform to the surface of the workpiece to a greater degree than in conventional CMP processes as illustrated in FIG. 1. This results in a more uniform pressure distribution over the workpiece surface as illustrated by line B in FIG. 2, than when employing a conventional CMP processes as illustrated by line A in FIG. 2.

Figure 3:
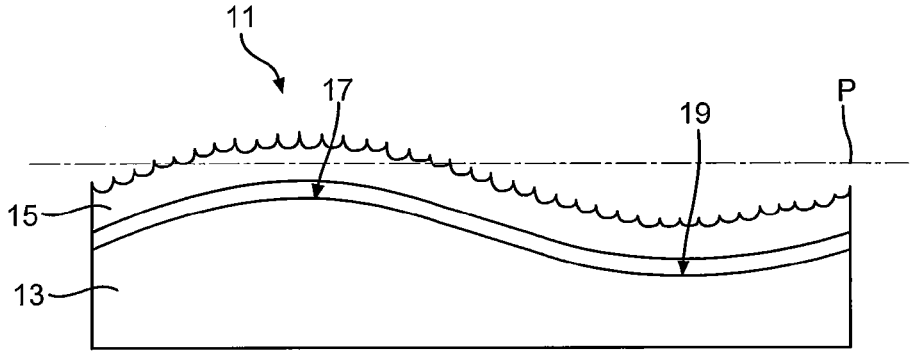
FIG. 3 is a schematic edge view of the surface of a silicon on glass (SOG) substrate.

The relatively more uniform polishing pressure provided by the polishing apparatus 50 and process described herein generates more uniform material removal across the workpiece surface, and thereby provides improved maintenance of film thickness uniformity during polishing and thinning of thin films on uneven surfaces and reduces pillowing of the workpiece when polishing and thinning rectangular or other non-circular workpieces compared to conventional CMP processes. As discussed above, uniform material removal across an uneven surface is important when polishing or thinning flat substrates having an uneven or undulating surface with a very thin layer of material on the uneven surface, such as SOI substrates as illustrated in FIG. 3, in order to avoid creating holes in the thin layer. Also as discussed above, uniform material removal is important when thinning and finishing rectangular substrates such as SOI substrate tiles and semiconductor donor tiles, in order to reduce pillowing of the substrates and to maximize the number of times a donor semiconductor tile may be refreshed and re-used in an ion implantation thin film transfer processes.

Figure 5:
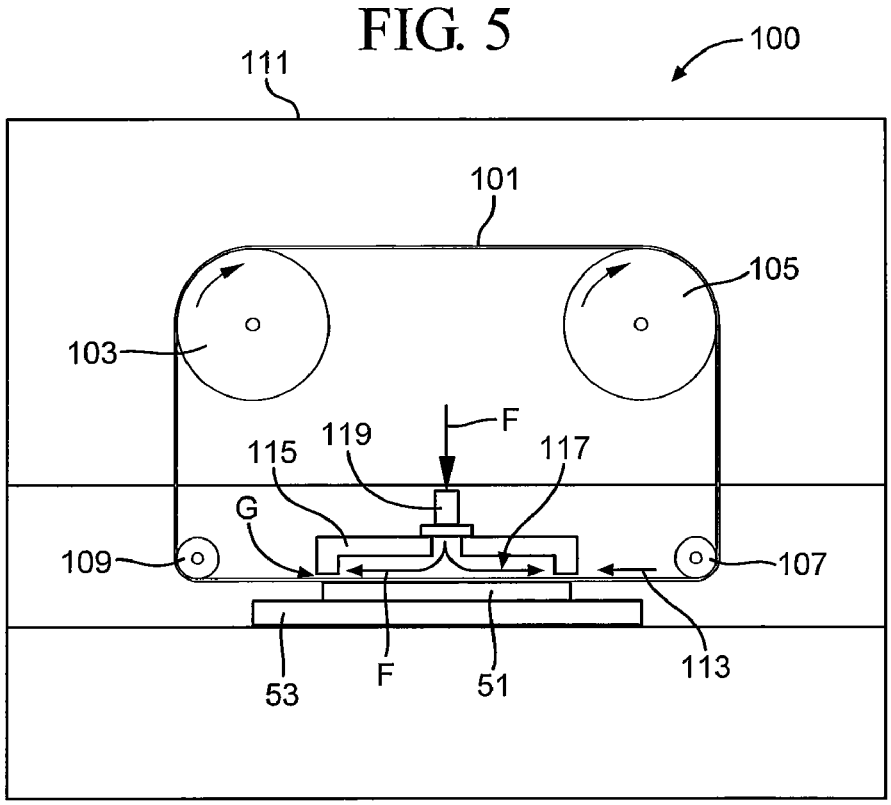
FIG. 5 is a schematic side view, taken along line V-V in FIG. 4, of one embodiment of a bulk removal polishing station according to the present invention.

The bulk material removal station 100 is diagrammatically illustrated in FIGS. 4 and 5. The bulk material removal station includes a continuous conformable abrasive belt 101 mounted on a number of rollers 103, 105, 107 and 109 on a frame or chassis 111. The workpiece 51 moves on the conveyor 53 under the polishing belt 101 in the x-direction (to the right in FIG. 4 and into the paper in FIG. 5) perpendicular to belt velocity 103 in the z-direction. The frame 111 is mounted on a positioning mechanism (not shown) that moves the frame and the rollers 103, 105, 107, 109, and therefore the continuous belt 101, up and down in the y-direction in order to position the polishing belt with respect to the conveyor 53 and achieve suitable clearances and engagement of the polishing belt against the workpiece 51. The rollers 103, 105, 107, 109 guide the belt 101 across the top surface of the workpiece 51. The belt 101 may be, for example, a continuous fixed abrasive polishing belt, such as a belt manufacture by the 3M Company, or a polyester belt with abrasive pads attached to it, such as a Politex™ belt from Rodel, Inc.

Uniform hydrostatic polishing pressure is applied to the back or top of the belt 101 by a hydrostatic pressure head 115 mounted to the frame directly above the belt 101. The pressure head 115 may be a downwardly facing cup-shaped head, with a downwardly opening pressure cavity or recess 117. The polishing belt spans pressure cavity 117, as illustrated in FIG. 5, substantially enclosing the pressure cavity. A constant pressure is maintained inside the pressure cavity by supplying a pressurized fluid F, e.g. CMP polishing slurry, to the pressure cavity via a fluid supply conduit 119 at a controlled pressure in a known manner. The pressurized fluid F in pressure cavity 117 acts as a hydrostatic pad for biasing the belt 101 against the workpiece 51. Fluid escapes F through a gap G between a rim of the pressure head and the polishing belt.

The size of the gap G and the viscosity, pressure and flow rate of the pressurized fluid F are selected to create and maintain a predetermined bulk removal polishing pressure within the pressure cavity 117, in order to, in combination with the belt 101 speed and conveyor 53 speed, produce a desired bulk removal of material from the workpiece 51 surface. If the gap G is too large (resulting in excessive fluid leakage through gap G), the viscosity of the fluid F is too low, or the flow rate of the fluid F is too low, then the pressure within the cavity 117 will drop below the desired bulk removal polishing pressure. Whereas if the gap G is too small (resulting in an overly restricted flow rate through gap G), the viscosity of the fluid too high, or the flow rate of the fluid is too high, then the pressure will in the cavity 117 rise above the desired bulk removal polishing pressure. The pressurized fluid F in the cavity 117 applies a uniform pressure to the back of the conformable abrasive belt 101, thus maintaining a uniform pressure against the workpiece 53 surface throughout the polishing area.

Figure 6:
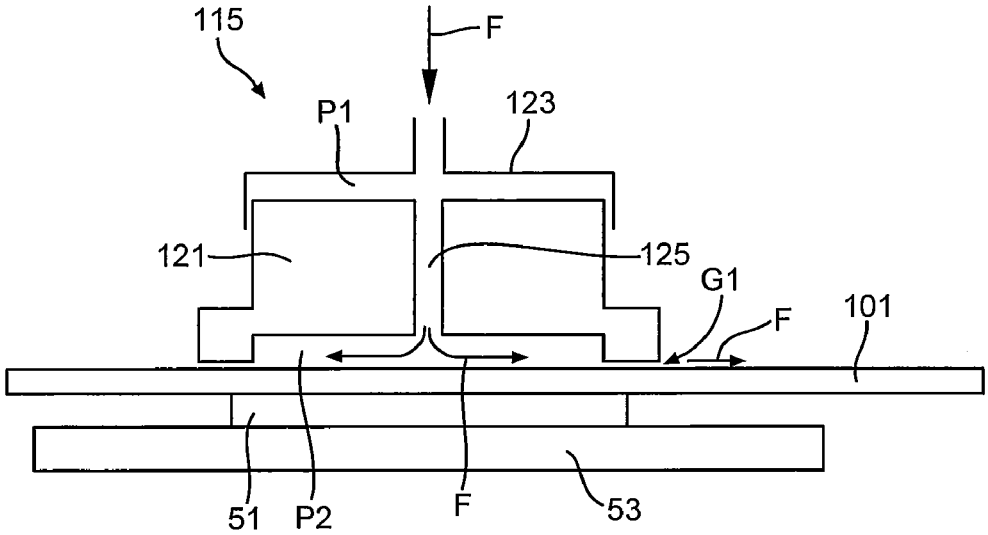
FIG. 6 is a schematic cross-sectional side view of one embodiment of a self-compensating hydrostatic polishing pad for use in the bulk removal polishing station of FIG. 5.

FIG. 6 illustrates an embodiment in which the hydrostatic pressure head 115 is a self-compensating hydrostatic pressure head in fluid communication with the moving belt such that the pad is operable to control the pressure between the moving belt and the top surface of the substrate in the associated pressure zone. The self-compensating pressure head includes a movable head 121 vertically movably mounted in housing 123, dividing the interior of the housing 123 into two separate pressure zones P1 and P2. An orifice 125 extends between the pressure zones P1, P2, which acts to equalize the pressures therebetween. The pressurized fluid F in pressure zone P2 acts as a hydrostatic pad for biasing the conformable belt 101 against the substrate 51. Fluid F escapes through the gap G, but is self-regulated, in order to ensure a programmed constant pressure is achieved in pressure zone P2 at the hydrostatic pad 115. If the gap G is too large, resulting in excessive fluid leakage through the gap, then the pressure at P2 drops below the pressure at P1. This pressure imbalance causes the movable head 121 to advance toward the belt 101, thereby closing the gap G1 and equalizing the pressure at P1 and P2. If the gap G1 is too small, resulting in insufficient fluid leakage through the gap, then the pressure at P2 rises above the pressure at P1. This pressure imbalance causes the movable head 121 to retract away from the polishing belt 101, thereby enlarging the gap G and equalizing the pressure at P1 and P2.

Figure 7:
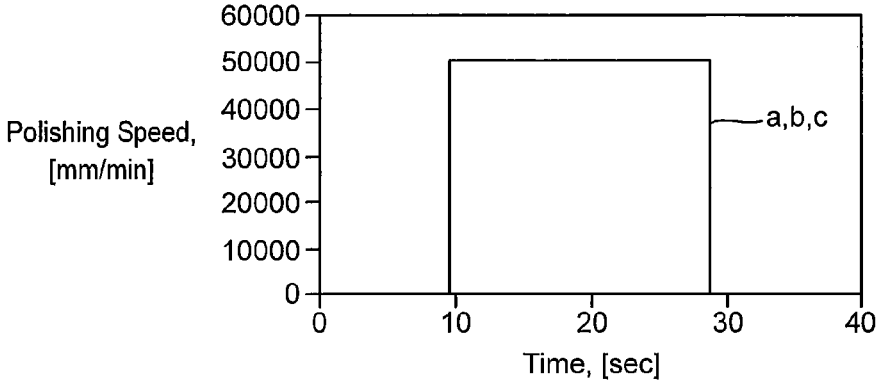
FIG. 7 is a plot illustrating the polishing speed and dwell time across the workpiece surface in the first polishing station of FIG. 4.

During operation, the belt 101 is continuously driven over the top surface of the workpieces 51 at a constant speed, a constant pressure is maintained in the pressure cavity P2, 117, and the workpieces move through the bulk material removal station 100 at a constant speed. The polishing speed at three locations a, b and c on the surface of the workpiece (See FIG. 4) as the workpieces pass under the polishing belt 101 was calculated using a workpiece with dimensions of 180 mm×230 mm, belt width of 180 mm, belt speed of 50,000 mm/min, and conveyor speed of 12 mm/sec. Point a is at the centerline of the workpiece, point c is adjacent the outer edge of the workpiece, and point b is midway between points a and c. The results are plotted in FIG. 7, which shows the polishing speed distribution at each of points a, b and c on the workpiece surface is substantially uniform/constant.

After the workpiece passes through the bulk material removal station 100, the workpiece passes through the finishing station 200, as schematically illustrated in FIG. 4. The workpiece moves through finishing station in the x direction, passing under a rotary polishing head having a conformable annular polishing pad 201 attached thereto. The workpiece surface is polished to the desired surface finish by the conformable polishing pad. Use of a conformable polishing pad enables a substantially uniform polishing pressure to be applied throughout the polishing area. The annular geometry of the polishing pad enables a relatively uniform polishing speed, and total polishing time to be applied across the workpiece surface, as compared to a circular polishing pad.

Figure 8:
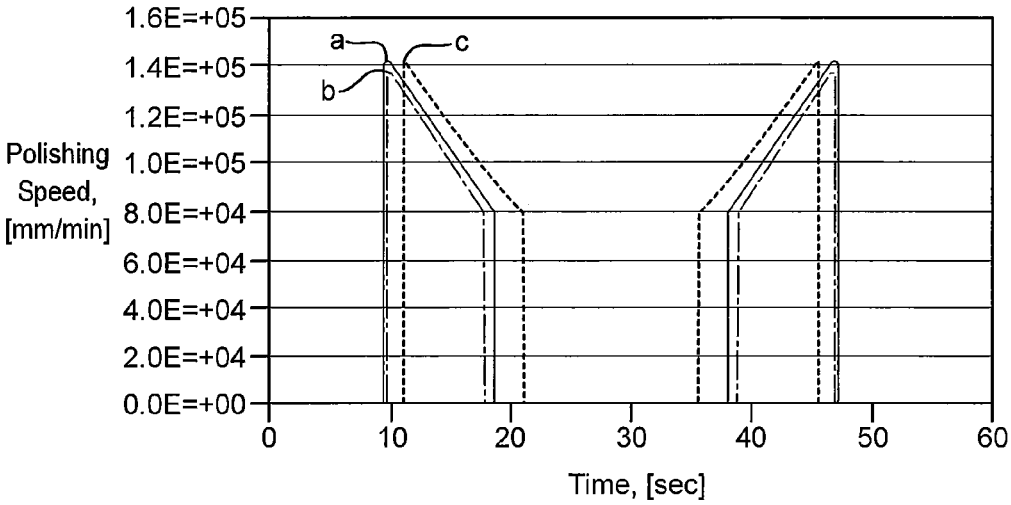
FIG. 8 is a plot illustrating the polishing speed and dwell time across the workpiece surface in the second polishing station of FIG. 4.

The polishing speed or velocity profiles at points a, b and c on the workpiece surface over time as the workpiece travels under the annular polishing pad 201 in the finishing station 200 were calculated using workpiece dimensions of 180 mm×230 mm, a pad inner diameter of 250 mm and outside diameter of 450 mm, a polisher rotational speed of 100 rpm, and conveyor speed of 12 mm/sec. The results are plotted in FIG. 8. The shape of polishing velocity profiles at the three locations is nearly the same, with only a relatively small variance in the polishing speed and time from the centerline of the workpiece at point a to the outer edges of the workpiece at point c. Thus, a relatively uniform polishing speed and time is provided across the workpiece 51 as it travels through the finishing polishing station 200, e.g. under the rotating conformable annular polishing pad 201, as compared to a rotating circular polishing pad. The difference in polishing time between point locations a and c may be only about 3.5 seconds. By providing generally uniform polishing pressure, speed and time across the workpiece surface, the conformable rotary polishing head described herein achieves substantially uniform material removal across the workpiece surface.

The precise geometry of the annular polishing pad will depend on the desired material removal rate and allowable velocity non-uniformity. By way of example, a ratio of 1:1.3:2.5, between workpiece part width, inner diameter of the annular polishing pad and outer diameter of the annular polishing pad, respectively, may be employed to achieve an allowable level of workpiece surface non-uniformity after finishing at the finishing polishing station.

Figure 9:
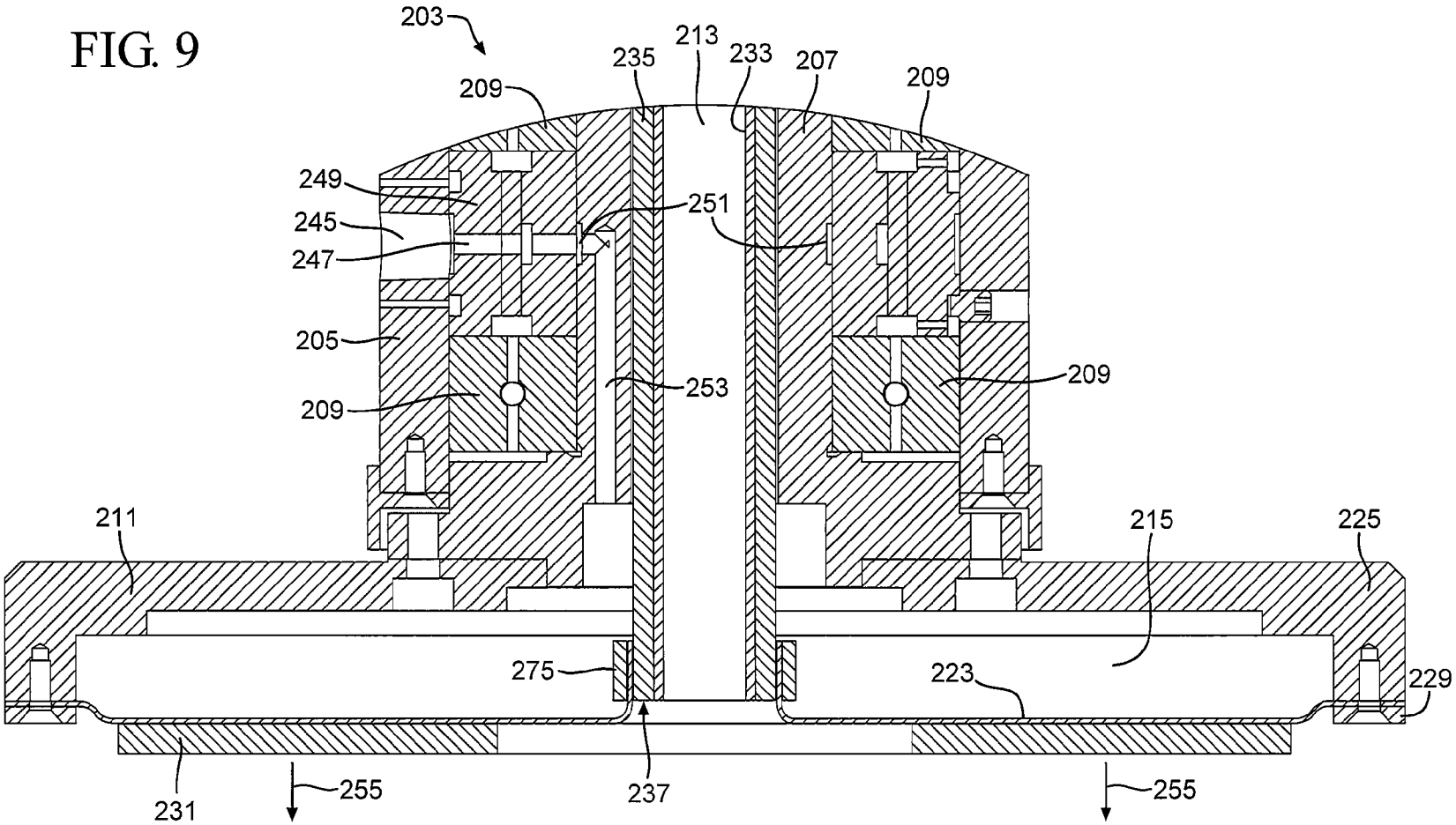
FIG. 9 is a cross-sectional side view of a rotary polishing head in accordance with one embodiment of the present invention.
Figure 10:
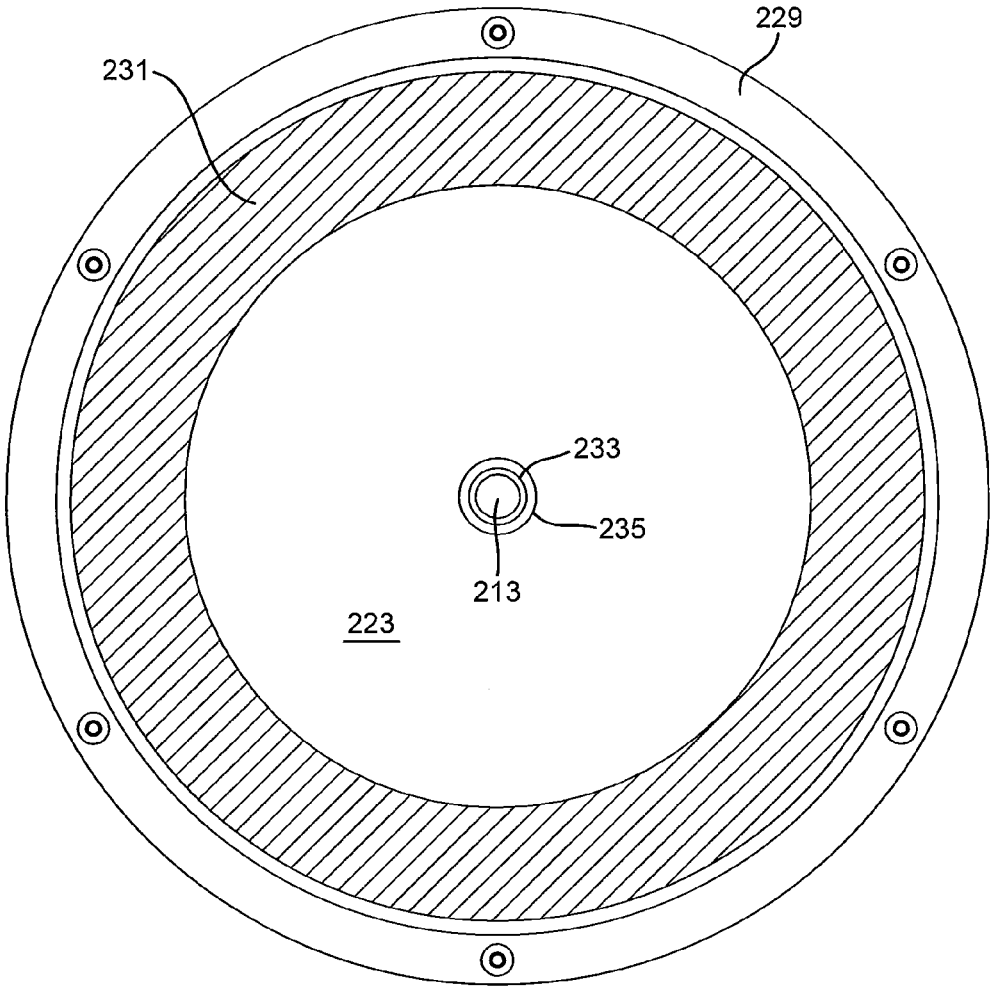
FIG. 10 is a bottom view of the rotary polishing head of FIG. 9.

FIGS. 9 and 10 illustrate one embodiment of a conformable rotary polisher 203 suitable for use in the finishing polishing station of FIG. 4. The conformable rotary polisher includes a polisher housing 205 with a spindle 207 rotational mounted in the polisher housing by bearings 209. A rotary polishing head 211 is mounted to a lower end of the spindle 207. A drive belt (not shown) extends between an output shaft of the motor (not shown) and a driven pulley (not shown) on an upper end of the spindle 207 for drivingly connecting the motor to the spindle and rotating the rotary polishing head 211. Drive trains other than a drive belt, such as a geared drive train, may be employed in place of the drive belt to drivingly connect the motor to the polisher spindle. A slurry supply conduit 213 extends through the center of the spindle.

The rotary polishing head 211 is a disc or upside down saucer shaped head having a downwardly facing open cavity 215. As best seen in FIG. 9, an elastic membrane 223 spans the gap between the rim 225 of the polishing head 211 and the supply conduit 213, thereby sealing the cavity 215 in the polishing head 211. The supply conduit may be formed on an inner metal tube 233 and an outer rubber tube 235. The outer peripheral edge portion of the annular flexible membrane 223 may be sealingly clamped between the rim 225 of the polishing head 211 and an outer clamp ring 229. The inner peripheral edge of the annular flexible membrane may be sealingly attached to the supply conduit 213 with a hose clamp 275 (or other suitable fast means) and the outer peripheral surface of the lower end 237 of the outer rubber tube 235. In this embodiment, the outer rubber tube 235 may be eliminated such that the inner peripheral edge of the annular membrane is clamped between the hose clamp 275 and the metal tube 233. However, the rubber tube may provide a more secure retention of the membrane 223 between hose clamp and the supply conduit 213. FIG. 9 illustrates the polishing head with the cavity 215 pressurized, such that the elastic membrane 223 is inflated, thereby biasing the polishing pad 231 downward against a workpiece surface (not shown). The polishing pad may, for example, have a modulus of elasticity of 10 to 100 MPA. The elastic membrane may, for example, have a modulus of elasticity of 1 MPa to about 100 MPa, or about 3 MPa.

A fluid port 245 is located in the polisher housing 205. A fluid channel 247 in a sleeve 249 (which may alternatively be an integral part of the polisher housing 55) communicates the fluid port with a peripheral groove 251 in the outer surface of the spindle 207. A longitudinal fluid channel 253 in the spindle communicates the peripheral groove 251 in the spindle with the cavity 215 in the polishing head 211. Pressurized fluid, such as air or oil, is supplied to the fluid port 245 and delivered to the sealed cavity 215 in the polishing head via the channels 247, 253 and the groove 251 for pressurizing the cavity 215 in a controlled manner as is well understood in the art.

The pressure in the cavity 215 applies a controlled and uniform polishing pressure to the back side of the conformable elastic membrane 223 and polishing pad 231, for pressing the polishing pad downward in the direction of arrows 255 against a workpiece surface (not shown). The elasticity of the membrane 223 and the polishing pad 231 also allows the polishing pad to conform to the surface of the workpiece, such that the polishing pressure is substantially uniform over high and low spots of an uneven workpiece surface, such as a thin exfoliated or deposited silicon film of an SOG substrate. The more elastic the polishing pad, the elastic membrane, and springs are, then the more uniform the pressure is across high and low spots on an uneven workpiece surface and the more uniform the material removal is across the workpiece surface. For example, the polishing pad may have a modulus of elasticity of 10 to 100 MPA. The elastic membrane may, for example, have a modulus of elasticity of 1 MPa to about 100 MPa, or about 3 MPa.

In a variation (not illustrated) of the embodiment of FIGS. 9 and 10, the annular elastic membrane 223 may be replaced with a circular elastic membrane. In which case, the supply conduit and the hose clamp may be eliminated from the polishing head. In which case the spindle would either be solid or, if hollow, plugged, such that the pressurized fluid in the cavity 215 cannot escape through the spindle. Polishing slurry may be provided to the work area via a supply conduit or nozzle located adjacent to the polishing head.

Figure 11:
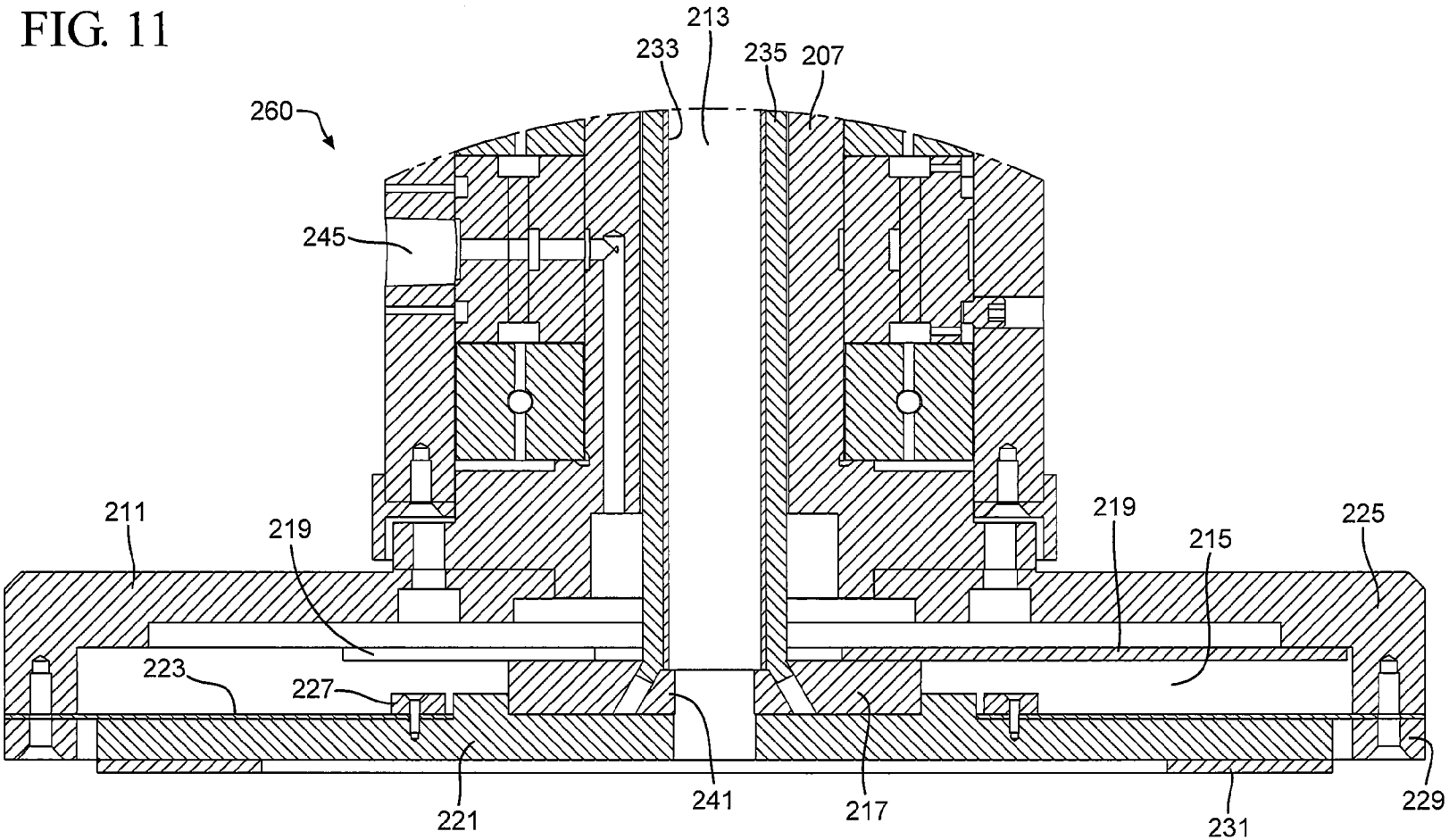
FIG. 11 is a cross-sectional side view of an alternative embodiment of a polishing head in accordance with the present invention.
Figure 12:
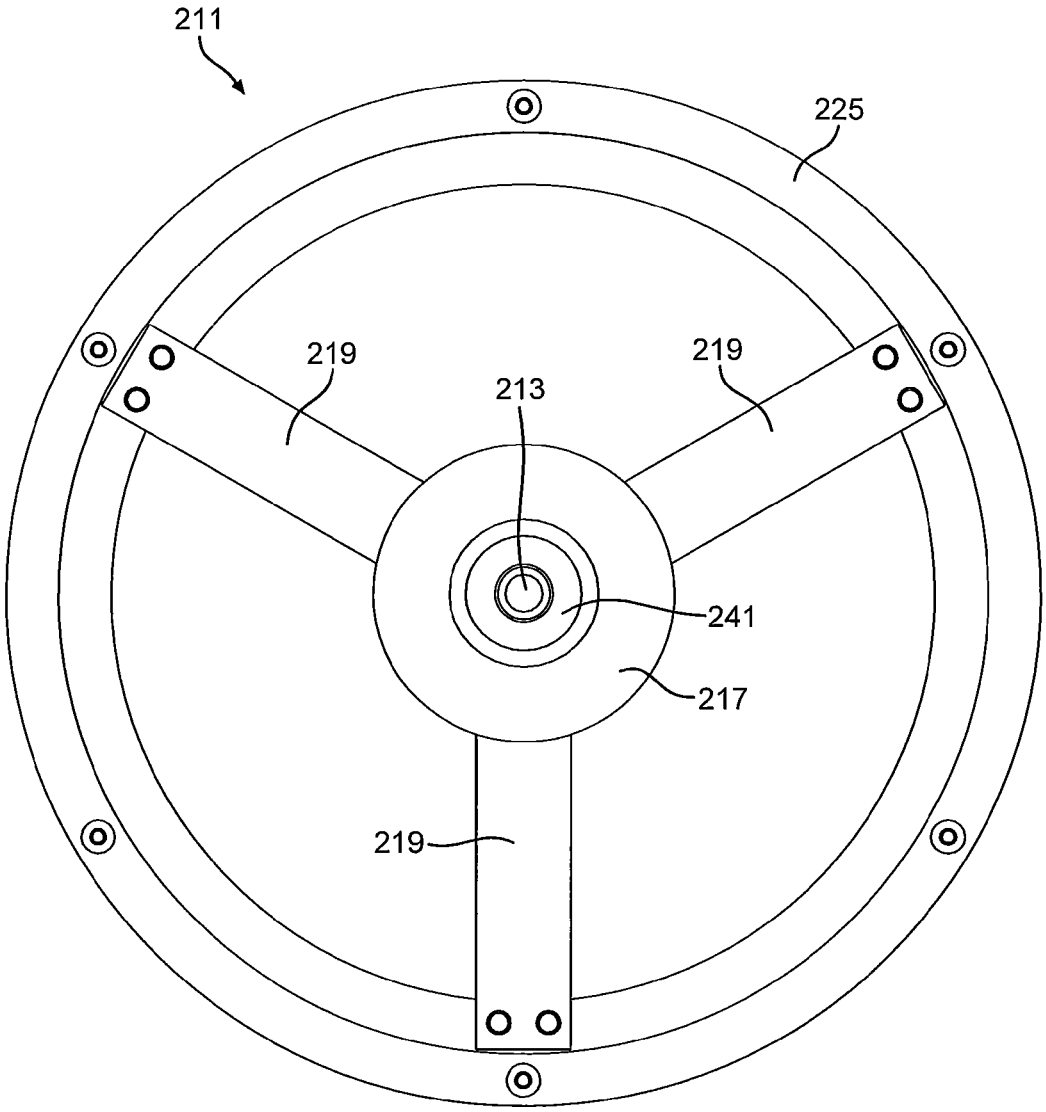
FIG. 12 is a bottom view of the polishing head of FIG. 12, with the polishing pad and mounting ring removed.

Referring now to FIGS. 11 and 12, in an alternative embodiment an annular hub 217 is resiliently suspended centrally in the polishing head 211 on flat springs 219 that extend radially from the polishing head 211 to the hub 217. The flat springs 219 are best seen in FIG. 12, which is a bottom view of the inside of the polishing had 211 with the cap, elastic membrane and clamp ring removed (these elements are described below). An annular cap or rigid disc 221 is attached to the hub 217 with screws or other suitable fasteners. The annular elastic membrane 223, for example, a latex membrane, spans the annular gap between the rigid disc 221 and a rim 225 of the rotary polishing head 211. An inner peripheral edge portion of the elastic membrane 223 may be securely clamped between an inner clamp ring 227 and the rigid disc 221. The inner clamp ring 227 may be attached to the rigid disc 221 with screws or other suitable fastening means. An outer peripheral edge portion of the flexible membrane 223 may be securely clamped between an outer clamp ring 229 and the rim 225 of the polishing head 211. The outer clamp 229 ring may be attached to the rim 225 of the polishing head with screws or other suitable fastening means. The flexible membrane 223 seals the cavity 215 in the polishing head. An annular flexible, e.g. conformable, abrasive polishing pad 231 is affixed to the exposed lower surface of the rigid disc 221. The elastic membrane may, for example, have a modulus of elasticity of 1 MPa to about 100 MPa, or about 3 MPa.

The hub 217 and rigid disc 221 may be mounted on a lower end of the supply conduit 213. Supply conduit 71 may be formed of an inner metal tube 233 and an outer rubber tube 235. The supply conduit 213 communicates with axially extending through holes in the hub 217 (and plug 241 as described hereinafter), rigid disc 221 and polishing pad 231 for delivering polishing slurry to a center of the polishing pad. The inner metal tube 233 serves to provide structural rigidity to the outer rubber tube 235. The lower end 237 of the flexible or elastic outer tube 235 extends beyond the lower end of the rigid metal inner tube in order to provide a resilient pivotal connection to the hub 217, as described in more detail below.

In order to mount the hub 217 to the lower end 237 of the outer rubber tube, the lower end of the outer rubber tube extends into a frustoconically expanding through-hole in the hub 217. A frustoconical plug 241 is inserted into the lower end 237 of the rubber tube. The plug 241 is securely clamped between the rigid disc 221 and the hub 217, such that the lower end 237 of the rubber tube is securely and sealingly clamped between the outer frustoconical surface of the plug 241 and the inner frustoconical surface of the hub 217. The end 237 of the outer rubber tube extends beyond the outer metal tube in order to resiliently mount the hub and cap to the spindle 207.

The resilient suspension of the hub 217 on the flat springs 219 and flexible outer rubber tube 235 enables the hub and disc 221 to tip or pivot on the lower end of the flexible outer rubber tube, thereby providing an added degree of conformability to polishing head 211. Alternatively, a universal or other gimbaled or pivoting joint may be employed to connect a rigid supply conduit 213 to the hub, and the outer rubber tube 235 may be eliminated. The inner metal tube may be formed of stainless steel or aluminum, for example, and the rubber outer tube may be formed of silicon or rubber, for example.

Experiments demonstrate that applying polishing pressure to the surface of the workpiece to be polished through a compliant conformable membrane and polishing pad results in more uniform polishing of the wafer and finishes a thin film to a more uniform thickness then when applying pressure through a rigid, non-conformable workpiece as in conventional CMP processes. This is because applying pressure through a compliant conformable polishing belt and/or a conformable rotary polishing pad results in a more uniform pressure distribution over the polishing area. Thus, the conformable polishing belts and pads as described herein may be advantageously used at the bulk removal station and finishing station to finish workpieces having thin films thereon, such as SOG or SOI substrates, without creating holes in the thin films and to finish rectangular or other non-circular workpieces, such as rectangular donor semiconductor tiles in an ion implantation thin film transfer process with a reduced pillowing effect.

Experiment 1

The as deposited single crystal silicon layers on SOG substrates were thinned using a multi-station polishing system as described herein. The bulk material removal was performed at a bulk removal station using a fixed conformable continuous abrasive belt as the SOG substrates moved through the bulk removal station on a conveyor-like carrier system. A total of 65 nm of silicon film was removed to leave an average final film thickness of 435 nm. The standard deviation of the thickness of the film following bulk material removal was found to be in the range of 3-4 nm, which is within wafer specifications for Silicon reuse. The thickness of the silicon layer was measured at nine different locations on the workpiece surface, and it was determined that an average film thickness of 16 Å rms was obtained.

The surface roughness was further improved by rotary polishing the wafer with the conformable rotary polishing head at a finishing polishing station. The workpiece surface texture/roughness of a Silicon wafer following finishing polishing was measured at 9 locations on the workpiece surface using atomic force microscopy ("AFM"). The surface roughness at the nine locations after finishing polishing was found to be in the range of 4-11 Å rms, which is within acceptable roughness levels for silicon wafer reuse in an ion implantation thin film transfer SOG fabrication process. The results of the AFM measurements are shown in Table 1.

TABLE 1

| Location | Wafer 1 | Wafer 2 |
|---|---|---|
| 1 | 4.3 | 6.4 |
| 2 | 8.1 | 6.7 |
| 3 | 4.1 | 4.8 |
| 4 | 4.1 | 5.4 |
| 5 | 4.1 | 7.8 |
| 6 | 3.5 | 5.6 |

TABLE 1-continued

| Location | Wafer 1 | Wafer 2 |
|---|---|---|
| 7 | 3.8 | 5.4 |
| 8 | 5.0 | 10.5 |
| 9 | 4.1 | 6.4 |

In accordance with one embodiment of a multi-station conformable CMP process as described herein. A plurality of flat rigid workpieces 21 with an uneven surface to be polished, such as an SOI substrate 11, is mounted on the conveyor. The workpieces are conveyed through the bulk removal station and the finishing station. The conveyor is driven at a speed of 720 mm/min, the polishing belt is driven at a speed of 30 m/min, and the rotary polishing head is driven at a speed of 100 revolutions per minute. A polishing pressure of 3 psi is maintained behind the polishing belt in the bulk removal station and a polishing pressure of 3 psi is maintained behind the annular polishing pad in the finishing station. Polishing slurry, such as cerium oxide, is supplied is supplied to the workpiece surface in polishing stations via the supply conduits.

Other processing stations, such as cleaning, metrology and packaging stations (not shown), may be combined with the bulk removal station and the finishing station along the same continuous conveyor. Although the multi-station polishing system is described herein as including a single bulk removal station and a single finishing station, it will be appreciated that multiple bulk removal stations and/or multiple finishing stations of decreasing aggressiveness and increasing finish or polish may be employed. Likewise, it may be possible within the scope of the presently described polishing system to obtain the desired surface finish with one or more conformable belt polishing stations, without the use of any rotary polishing stations. Similarly, it may be possible within the scope of the presently described system to obtain the desired surface finish with one or more conformable rotary polishing stations, without the use of any belt polishing stations.

The particle size and concentration of abrasive particles in the polishing slurry, the size and distribution of abrasive particles or protrusions on the polishing pad design of a polishing belt and the polishing pad, the polishing pressure, e.g. the controlled pressures, and the belt and rotary polishing speed, can be selected to achieve relatively high removal rates, while generating good surface uniformity and finish.

The polishing belt in the bulk removal may include a fixed abrasive structure, which may be a micro-replicated pattern of micron-sized posts on the contact surface thereof. The posts may contain an abrasive material in a resin-like matrix. The fixed abrasive materials may be obtained from the 3M Company, St. Paul, Minn. Such an embodiment is believed to be advantageous when polishing silicon on glass (SOG) substrates. Using conventional polishing techniques, the abrasive particles reach the exposed surface of the substrate under treatment, and removal of material occurs both on elevated and lower areas of the abrasive material. In the case of fixed abrasive polishing using the micro-replicated pattern of micron-sized posts 160, the abrasive particles are bound in the elevated posts of the pad. Thus removal of material occurs mainly at the elevated areas of the exposed posts 160. Thus, the material removal rate, expressed as a ratio of removal between topographically higher versus lower areas of the workpiece, is much higher than in the case of conventional techniques, such as slurry-based CMP.

The polishing slurry may be any suitable commercially available CMP polishing slurry, such as a cerium oxide, or other colloidal silica slurry. Use of a cerium oxide will reduce the cost of consumables compared to using expensive slurries which are used in conventional CMP.

The elastic membrane in the rotary polishing head may be formed of any suitable elastic material, such as latex or silicone rubber, for example. The elastic membrane preferably has a modulus of elasticity of about 1 to about 100 MPa.

The polishing pad in the finishing station may be a porous polishing pad, such as porous-non-fibrous pads produced by coagulating polyurethane, and in particular, coagulating a polyetherurethane polymer with polyvinyl chloride commercially, and are available as POLITEX™ high, regular and low nap height polishing pads sold by Rodel, Inc. The abrasive pad may include a fixed abrasive structure, which is a micro-replicated pattern of micron-sized posts on the contact surface thereof. The posts contain an abrasive material in a resin-like matrix. The fixed abrasive materials may be obtained from the 3M Company, St. Paul, Minn. Such an embodiment is believed to be advantageous when polishing silicon on glass (SOG) substrates. The surface of the polishing pad that engages the workpiece surface is preferably deeply grooved or channeled. By way of example, the grooves may be in a perpendicular, cross-hatched arrangement on the order of about 21 mm×21 mm in a Cartesian coordinate plane and may be about 1 mm or more deep. A suitable polishing pad may be obtained from Rohm-Haas Incorporated, presently sold as SUBA 840 PAD 48"D PJ; XA25 (supplier material number 10346084). Alternative patterns for the groove 222 are possible, such as diamond-shaped grooves, spiral-shaped grooves, radially and/or circumferentially extending grooves, etc.

The workpiece may be any material, such as glass, glass ceramic, semiconductor, and combinations of the above, such as semiconductor on insulator (SOI) or semiconductor on glass (SOG) structures, and may be round, rectangular or other non-round shape. In the case of semiconductor materials, such may be taken from the group comprising: silicon (Si), germanium-doped silicon (SiGe), silicon carbide (SiC), germanium (Ge), gallium arsenide (GaAs), GaP, and InP.

Advantages of one or more embodiments described herein include, but are not limited to:

a. The conformable polishing belt and pad provide a more uniform polishing pressure distribution over the workpiece surface as compared with the conventional CMP process.
b. The more uniform polishing pressure application eliminates the need for a stiff machine structure unlike conventional CMP, in which the machine structure has to be rigid in order to get desired wafer planarity.
c. A substantially uniform material removal across the workpiece surface is achieved, because generally uniform polishing pressure, velocity and time is applied across the entire workpiece surface during polishing at both stations.
d. An efficient and economical continuous process without interruption is achieved by elimination of the workpiece loading and unloading steps required between different processes in conventional CMP process.
e. The device that holds the workpiece during polishing (the conveyor) is separated from the polishing mechanism that applies pressure to and polishes the surface of the workpiece, providing for a simpler polishing mechanism compared with conventional CMP.
f. Separating the workpiece holding device from the polishing mechanism makes it possible to perform wafer polishing on a continuous conveyor system, thereby eliminating part handling and transfer time between different polishing stages or stations resulting in increased productivity and reduced costs.

g. Different polishing processes such as bulk material removal, finishing and buffing, cleaning, metrology and packaging may be combined on a single machine or manufacturing line by performing the steps along the same continuous conveyor.

Although a multi-station polishing system and process has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A conformable polishing apparatus, comprising:

a bulk material removal station;

a finishing polishing station;

a conveyor on which a plurality of substrates may be releasably coupled and conveyed, one workpiece at a time, through the bulk material removal station and the finishing station in a continuous process;

the bulk material removal station includes a moving conformable abrasive belt located with respect to the conveyor such that the abrasive belt conformably contacts a top surface of a substrate travelling through the bulk removal station with a substantially uniform polishing pressure and polishing time across a full width of the substrate and substantially uniformly removes material from the entire top surface of the substrate; and the finishing polishing station includes a rotary conformable annular polishing pad located with respect to the conveyor such that the polishing pad conformably contacts a top surface of a substrate travelling through the finishing station with a substantially uniform polishing pressure and polishing time across a full width of the substrate and substantially uniformly removes material from the entire top surface of the substrate.

2. A conformable polishing apparatus according to claim 1, wherein the bulk material removal station further comprises a hydrostatic pressure head for pressing the belt against a surface of a workpiece:

the hydrostatic pressure head comprises a cup-shaped housing, the housing having a rim facing and spaced from the belt defining a gap between the rim of the housing and the belt, a polishing slurry supply port in the housing for supplying polishing slurry to an interior of said head and through the gap to a surface of the workpiece, the gap and slurry flow rate being selected to provide a desired polishing pressure in the interior of the pressure head for pressing the belt against a surface of a workpiece.

3. A conformable polishing apparatus according to claim 2, wherein the hydrostatic pressure head further comprises:

a polishing slurry supply port in the housing;

a pressure head vertically movably mounted in the housing, the rim being formed by the pressure head, the pressure head dividing an interior of the housing into a first pressure zone between the head and the belt and a second pressure zone between the head and the housing in communication with the supply port;

an orifice in the pressure head communicates the first pressure zone with the second pressure zone to equalize the pressures in the first pressure zone and the second pressure zone when polishing slurry is supplied under pressure through the supply port to the second pressure zone, through the orifice to the first pressure zone and through the gap, and thereby providing a substantially constant and uniform pressure in the first pressure zone against a back side of the belt to press the belt against a surface of a workpiece with a substantially constant polishing pressure.

4. A conformable polishing apparatus according to claim 1, wherein the finishing polishing station further comprises a rotary polisher having a resiliently conformable annular polishing pad mounted thereon for contacting and resiliently conforming to a surface of a workpiece.

5. A conformable polishing apparatus according to claim 4, wherein the rotary polisher further comprises:

a rotary polishing head, a cavity in the rotary polishing head behind the annular polishing pad, and a pressurized fluid supply channel communicating with the cavity for providing fluid at a controlled pressure to the cavity and pressing the annular polishing pad against a surface of a workpiece coupled to the base with a uniform pressure.

6. A conformable polishing apparatus according to claim 5, wherein:

a supply conduit extending axially through a center of the polishing head and a center of the polishing pad for supplying polishing slurry to a center of the polishing pad.

7. A conformable polishing apparatus according to claim 5, wherein:

the cavity is an open cavity and an elastic membrane spans and sealingly encloses the cavity to form a pressure cavity in the rotary polishing head;

the annular polishing pad is mounted on an outer surface of the elastic membrane; and a fluid supply channel in the polishing head communicates with the pressure cavity for providing fluid at a controlled pressure to the pressure cavity for inflating the elastic membrane and pressing the annular polishing pad against a surface of a workpiece coupled to the base with a uniform pressure.

8. A conformable polishing apparatus according to claim 7, wherein:

the rotary polisher includes a spindle;

the rotary polishing head is mounted on an end of the spindle;

a supply conduit extends axially through a center of the spindle; and there is a hole in a center of the elastic membrane defining an inner peripheral edge on the elastic membrane, wherein the inner peripheral edge of the elastic membrane is sealingly attached to an end of the supply conduit, such that polishing slurry is supplied through the supply conduit to a center of the annular polishing pad.

9. A conformable polishing apparatus according to claim 1, wherein the finishing polishing station further comprises:

a rotary polishing head;

an inflatable elastic membrane on an outer face of the rotary polishing head, with the flexible annular polishing pad attached to an outer surface of the inflatable elastic membrane; and a means for inflating the elastic membrane to a controlled pressure and pressing the polishing pad against a surface of a workpiece with a uniform polishing pressure.

10. A conformable polishing apparatus according to claim 9, wherein the bulk material removal station further comprises a hydrostatic pressure head for pressing the belt against a surface of a workpiece.

11. A conformable polishing apparatus according to claim 10, wherein the hydrostatic pressure head further comprises a cup-shaped housing, the housing having a rim facing and spaced from the belt defining a gap between the rim of the housing and the belt, a polishing slurry supply port in the housing for supplying polishing slurry to an interior of said head and through the gap to a surface of the workpiece, the gap and slurry flow rate being selected to provide a desired polishing pressure in the interior of the pressure head for pressing the belt against a surface of a workpiece.

12. A conformable polishing apparatus according to claim 1, wherein the bulk material removal station further comprises a self compensating hydrostatic pressure head in fluid communication with one of the moving belt such that the pad is operable to control the pressure between the moving belt and the top surface of the substrate in the associated pressure zone.

13. A method of conformable polishing and uniformly removing material from a surface of a workpiece, comprising:

mounting a flat workpiece on a conveyor and conveying the workpiece through a bulk material removal station and a finishing station;

removing material from a top surface of the workpiece using a continuous conformable abrasive belt in the bulk material removal station, such that the conformable belt conforms to the surface of the workpiece to apply a substantially uniform polishing pressure and removes a substantially uniform thickness of material from the surface of the workpiece as the workpiece travels through the bulk material removal station; and polishing the top surface of the workpiece to a desired surface finish at the finishing station with a rotating conformable annular polishing pad, such that the conformable annular polishing pad conforms to the surface of the workpiece to apply a substantially uniform polishing pressure and removes a substantially uniform thickness of material from the surface of the workpiece as the workpiece travels through the finishing station.

14. A method according to claim 13, wherein the step of polishing at the finishing station further comprises providing an inflatable elastic membrane behind the annular polishing pad, inflating the elastic membrane, and thereby conformably pressing the annular polishing pad against the surface of the workpiece with a substantially uniform pressure.

15. A method according to claim 14, wherein the step of polishing at the finishing station further comprises supplying polishing slurry through a center of the elastic membrane and a center of the polishing pad to the surface of the workpiece.

16. A method according to claim 13, wherein:

the workpiece has an undulating surface and a layer of material on the undulating surface, the layer of material having a thickness that is less than a height of undulations on the surface; and the steps of removing material at the bulk material removal station and polishing at the finishing station each remove a substantially uniform thickness of material from the layer of material without entirely removing the layer of material at a top of any undulations on the surface of the workpiece.

17. A method according to claim 13, wherein the workpiece is a non-round workpiece.

18. A method according to claim 17, wherein the workpiece is a flat rectangular workpiece.

19. A method according to claim 18, wherein the layer of material is thinner than the height of the undulations by a factor of 10 or more.

20. A method according to claim 17, wherein the workpiece is a flat rectangular workpiece.

21. A method according to claim 13; wherein the step of removing material at the bulk material removal station further comprises generating a uniform hydrostatic pressure against a surface of a workpiece.

22. A method according to claim 21, wherein the uniform hydrostatic pressure is self balancing.

23. A method according to claim 21, wherein the step of polishing at the finishing station further comprises providing an inflatable elastic membrane behind the annular polishing pad, inflating the elastic membrane, and thereby conformably pressing the annular polishing pad against the surface of the workpiece with a substantially uniform pressure.

24. A method according to claim 23, wherein the step of polishing at the finishing station further comprises supplying polishing slurry through a center of the elastic membrane and a center of the polishing pad to the surface of the workpiece.

25. A semiconductor on insulator substrate polished in accordance with the method of claim 13.

* * * * *